United States Patent [19]

Woyke

[11] Patent Number: 4,513,584

[45] Date of Patent: Apr. 30, 1985

[54] METHOD AND APPARATUS FOR ABSORPTION REFRIGERATION

[76] Inventor: John F. Woyke, 132 Long Lots Rd., New Canaan, Conn. 06840

[21] Appl. No.: 283,510

[22] Filed: Jul. 15, 1981

Related U.S. Application Data

[63] Continuation-in-part of Ser. No. 111,090, Jan. 10, 1980, abandoned.

[51] Int. Cl.[3] ..... A63C 19/10

[52] U.S. Cl. ..... 62/235.1; 415/121 B; 62/476

[58] Field of Search ..... 62/235.1, 324.1, 476; 126/422, 433, 499; 415/108, 125, 126, DIG. 6, 121 B, 121 G, 114; 165/1

[56] References Cited

U.S. PATENT DOCUMENTS

| | | | |
|---|---|---|---|
| 4,050,445 | 9/1977 | Huse | 126/422 |
| 4,149,585 | 4/1979 | Sterlini | 165/1 |
| 4,285,211 | 8/1981 | Clark | 62/235.1 |

*Primary Examiner*—Albert J. Makay
*Assistant Examiner*—Henry Bennett
*Attorney, Agent, or Firm*—Frank J. Thompson

[57] ABSTRACT

An absorption refrigeration method and apparatus is described wherein a heated fluid for supplying operating thermal energy to a generator of the apparatus is preheated to a temperature for efficient operation of the apparatus. Preheating is provided by vaporizing a previously heated liquid phase fluid, compressing the vapor and condensing the compressed vapor in heat exchanging relationship with the generator. A rotary pump is provided for enhancing efficiency. In a preferred embodiment, the fluid is heated by a solar energy source.

1 Claim, 12 Drawing Figures

70
103
78
72
8
106
74
108
76
98
101
102
84
79
100
86
80
160
90
162
96
82
88
104
112
113
110
164
114
118
168
120
116
166

129
125
143
86
126
108
78
84
134
A
131
88
122
90
133
132
LOW PRESSURE
92
94
128
B
127
82
74
130
112
116

86
125
129
84
78
108
A
131
122
74
92
LOW PRESSURE
133
COMPRESSION
94
90
82
134
74
132
B
130
112
127
88

141
137
136
78
78
142
143
143
129
86
86
126
125

86
129
108
84
A
125
74
133
131
LOW PRESSURE
94
122
90
92
B
132
130
134
82
78
127
116
112
88

131
84
130
129
125
133
B
127
122
A
94
86
92
90
88
108
LOW PRESSURE
132
112
82
134
74
78
116

METHOD AND APPARATUS FOR ABSORPTION REFRIGERATION

RELATED APPLICATION

This is a continuation in part application of my prior U.S. application Ser. No. 111,090 filed on Jan. 10, 1980, now abandoned.

BACKGROUND OF THE INVENTION

1. Field of the Invention

This invention relates to an improved absorption refrigeration method and apparatus. The invention relates more particularly to a method and apparatus for increasing the temperature of a fluid which supplies operating energy to an absorption refrigeration apparatus.

2. Description of the Prior Art

An absorption refrigeration apparatus, with which the present invention is concerned, is known in the art and generally includes an evaporator means in heat transfer relationship with a fluid to be chilled, a condenser means in heat transfer relationship with a means for discharging to the atmosphere thermal energy removed from the chilled fluid, and an absorber/generator means. Operating energy for the apparatus is supplied to the generator principally in the form of thermal energy. In one type of absorption refrigeration apparatus, thermal energy is supplied to the generator by a heated fluid which is conveyed in heat exchange relationship, through the generator. When a relatively low cost fluid heating medium is available for use in transferring heat to the generator, the cost of operation in terms of energy input are advantageous.

The absorption type of refrigeration system operates efficiently when a fluid providing thermal energy to the generator is supplied within a range of supply temperatures. In general, the particular range of supply temperatures ($T_1$–$T_2$) is dependent upon the refrigerant medium utilized with the absorption refrigeration apparatus. An absorption refrigeration apparatus employing lithium bromide as a refrigerant operates efficiently when the heated fluid supplied to the generator is provided at a temperature in the range of 190° F.–210° F. while the temperature range for an ammonia refrigerant lies between 250° F.–300° F. As indicated, the absorption refrigeration apparatus provides energy cost advantages when thermal energy is available within the indicated temperature range. At times however thermal energy is available but at temperatures which, while relatively high, are still below that range of temperatures at which the absorption refrigeration apparatus efficiently operate.

Various techniques have been used for supplementing energy available with fluids at a temperature less then the efficient operating temperature of the absorption refrigeration apparatus and raising the temperature of the fluid to the desired range ($T_1$–$T_2$). These techniques have provided for the use of electrical energized heating elements or the use of a gas fired means for raising the temperature of the supply fluid. However, the absorption refrigeration apparatus has a coefficient of performance of less than one and energy supplied with these techniques for increasing the temperature of the supply fluid can more efficiently be used to directly operate the refrigeration equipment therefor. In one technique, this drawback is partially compensated by recovery of some useful work by the reexpansion of air after it passes through a heat exchanger. Nonetheless air is a poor heat transfer medium and unless a heat exchanger is relatively large and a substantial volume of air flows through it, inadequate energy will be delivered to the absorption refrigeration apparatus to satisfy increasing load requirements.

It is also desirable to limit the temperature decrease of the supply fluid as it is circulated between the generator heat exchanger and a reservoir containing the heated fluid. However, when the temperature of this heated fluid is raised by an auxiliary external energy means to cause the apparatus to operate at maximum efficiency, the output stream of the generator heat exchanger is substantially higher in temperature than the reservoir temperature of the fluid and the auxiliary temperature enhancing source is then required to supply a substantial proportion of the energy for operating the absorption refrigeration apparatus.

SUMMARY OF THE INVENTION

Accordingly, it is an object of this invention to provide an improved method and apparatus for absorption refrigeration.

Another object of the invention is to provide an improved method and apparatus for increasing the temperature of a heated fluid supplied to a generator of an absorption refrigeration apparatus.

Another object of the invention is to provide an absorption refrigeration apparatus which operates efficiently with heated energy supply fluids of relatively low temperature.

Another object of the invention is to provide an improved energy efficient means for preheating a heated fluid medium which supplies thermal energy to a generator of an absorption refrigeration apparatus.

Another object of the invention is to provide an improved rotary pump.

Still another object of the invention is to provide an improved solar energy operated air-conditioning apparatus having an absorption refrigeration means.

A first fluid is heated to a temperature $T_0$ which is less than a temperature $T_1$ at which an absorption refrigeration apparatus efficiently operates. In accordance with features of the method of the invention, the first liquid phase fluid is preheated to the temperature $T_1$ by successively vaporizing the heated liquid and compressing the heated vapor. The heated vapor is condensed by a rotary pump means in heat exchange relationship with a generator of the apparatus thereby supplying operating thermal energy to the apparatus. In a particular embodiment of the invention, the liquid is heated by solar radiant energy to the temperature $T_0$ by a solar energy source in heat exchange relationship with the first fluid.

In accordance with features of the apparatus of the invention, an absorption refrigeration means is provided having a generator in heat transfer relationship with a first inlet fluid and an evaporator in heat transfer relationship with a second outlet fluid. The refrigeration means which is adapted to operate efficiently above an inlet fluid temperature $T_1$ receives thermal energy transferred to the generator from the first fluid and utilizes the transferred energy for causing cooling of the second fluid at the evaporator. A thermal energy source in heat transfer relationship with the first fluid heats the first fluid to a temperature $T_0$ which is less than the temperature $T_1$. In a preferred embodiment, the thermal energy source comprises a solar energy source. A rotary pump preheating means is provided for heating and supplying the heated first fluid to the generator at or above the temperature $T_1$ and causes vaporization of the liquid phase fluid and successive compression thereof. The vaporized compressed fluid is conveyed to a heat exchange means at the generator where it condenses and transfers thermal energy to the generator. In a particular embodiment of the invention, the desired pressure is established in a reservoir and the vapor is compressed by a rotary pump means positioned between the reservoir and the heat exchange means at the generator. In an alternative embodiment, a rotary pump is positioned in a vessel containing a heat transfer medium. The vessel is in heat transfer relationship with the thermal energy source and refrigeration means.

BRIEF DESCRIPTION OF THE DRAWINGS

These and other objects and features of the invention will become apparent with reference to the following specification and to the drawings wherein.

DETAILED DESCRIPTION

Figure 1:
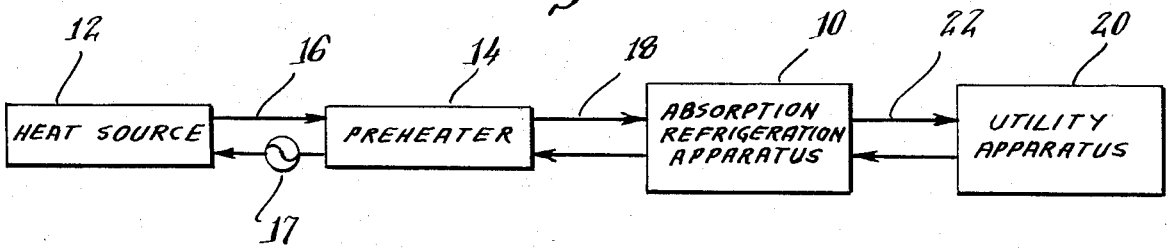
FIG. 1 is a diagram in block form illustrating a cooling apparatus constructed in accordance with features of the present invention.
Figure 6:
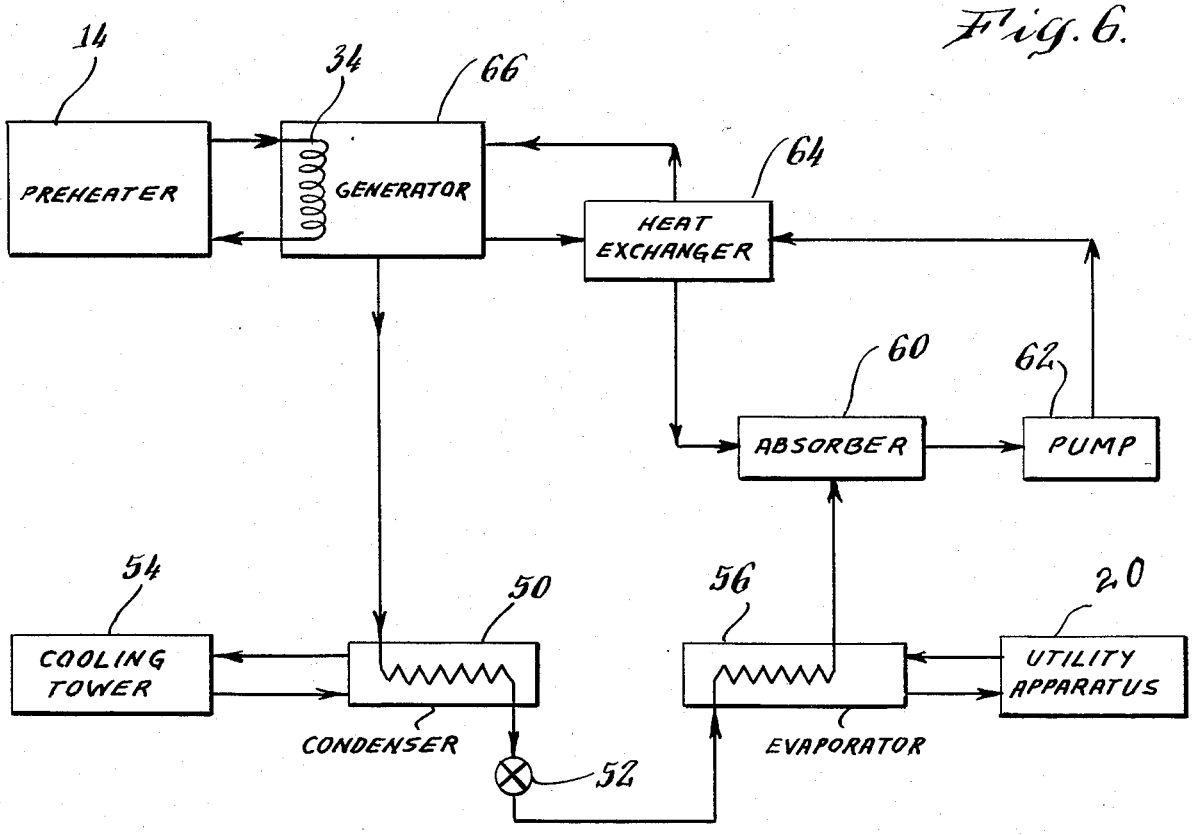
FIG. 6 is a schematic diagram illustrating an absorption refrigeration means of FIG. 1.

Referring now to the drawings, and particularly to FIG. 1, an absorption refrigeration apparatus 10 is shown to derive operating thermal energy from a heat source 12. The absorption refrigeration apparatus 10, a particular embodiment of which is described in greater detail hereinafter with respect to FIG. 6, is known in the art. Absorption refrigeration systems are presently sold by the Carrier Corporation, Trane Corporation, Singer Corporation and Servel Division of Arkla Industries, Inc. Detailed descriptions of absorption systems are found in Applied Thermodynamics by Virgil Moring Faires, revised edition 1947, The MacMillan Company, New York, §303 at pages 385 through 388 and in Heating, Ventilating and Air-Conditioning Fundamentals, William H. Severns and Julian R. Fellows, second edition, 1954, John Wiley and Sons, Inc., §363 at pages 504 through 505, the disclosures of which are incorporated herein by reference. Thermal energy is supplied to a generator means (FIG. 6) of the absorption refrigeration apparatus 10 by a first fluid medium which is heated to a temperature $T_0$ by the heat source 12 and with which the first fluid is in heat exchange relationship. The temperature $T_0$ is less than a temperature $T_1$ of a range of temperatures ($T_1$–$T_2$) within which the absorption refrigeration apparatus 10 efficiently operates. Heat source 12 represents a relatively low cost energy source and comprises, for example, a geothermal source, recovered waste heat from manufacturing processes, recovered waste heat from commercial and domestic laundering processes, etc. Preferably, the heat source 12 comprises a solar energy panel which is heated by solar radiant energy as described in greater detail hereinafter. The heat transfer fluid medium comprises a liquid phase fluid such as water. Thermal energy is conveyed by the heated medium between the heat source 12 and the apparatus 10 through a preheating means 14, conduit means 16, and a pump 17. Preheating means 14 provides for elevating the temperature of the preheated first fluid medium from a temperature $T_0$ to the temperature $T_1$ at which temperature the absorption refrigeration apparatus 10 efficiently operates. A utility apparatus including an enclosed environment which is to be cooled is coupled in heat exchanging relationship with the absorption refrigeration apparatus 10. A second fluid medium such as water is conveyed by conduit means 22 between the utility apparatus 20 and an evaporator means (FIG. 6) of the apparatus 10. The second fluid gives up heat at the evaporator means whereby it is chilled and conveyed to the utility apparatus for air conditioning and cooling use.

Figure 2:
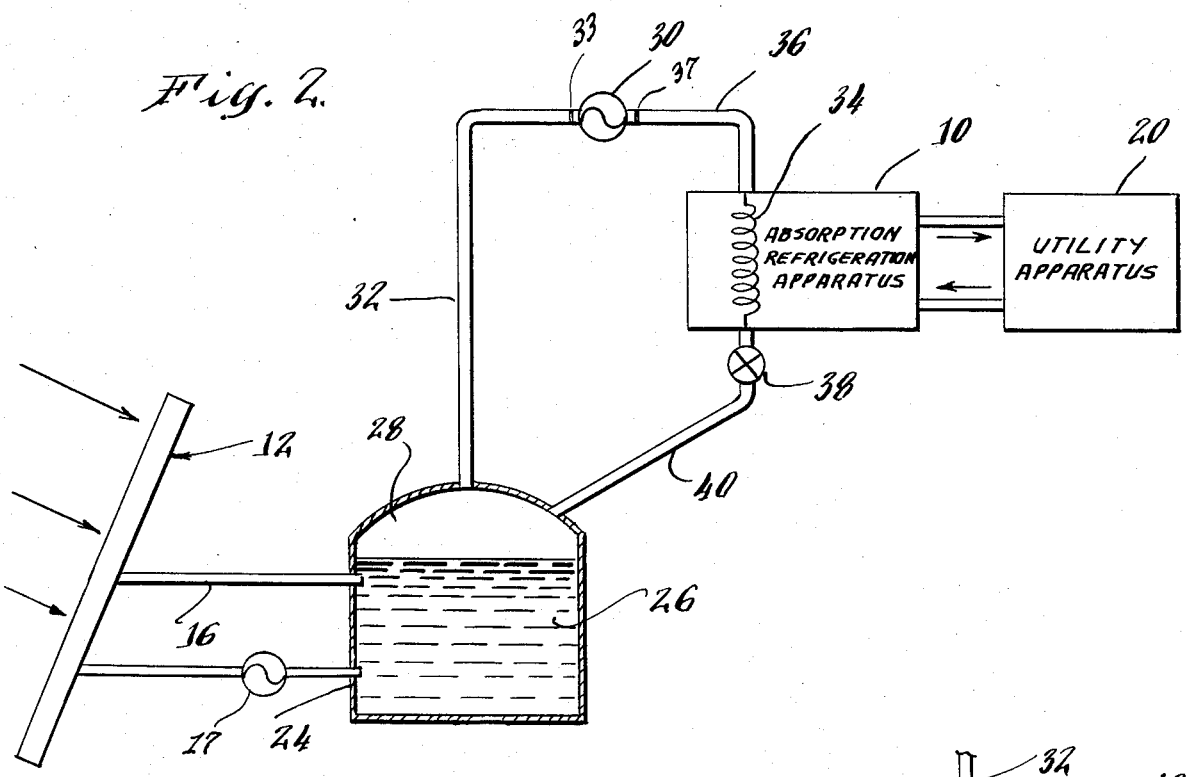
FIG. 2 is a diagram partly in schematic and partly in block form illustrating a preheating means constructed in accordance with one embodiment of the present invention.
Figure 4:
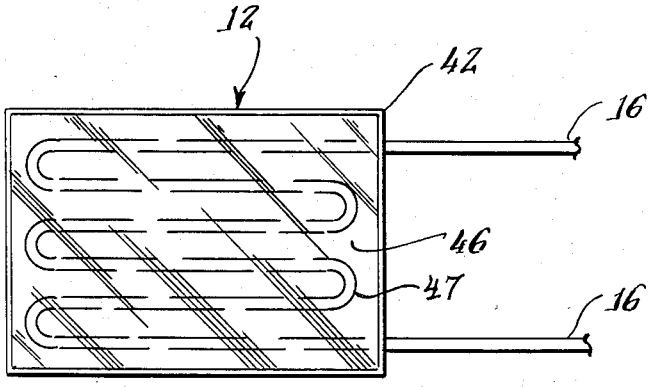
FIG. 4 is a plan view of a solar heater panel used with the apparatus of FIG. 2.
Figure 5:
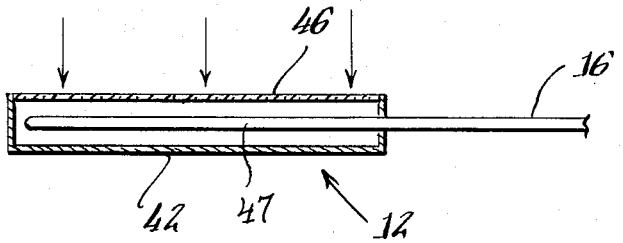
FIG. 5 is a side elevation view, partly in section, of the solar panel of FIG. 4.

Referring now to FIGS. 2, 4 and 5, the heat source 12 is shown to preferably comprise a flat plate solar collector panel 42 (FIG. 4) which is positioned for impingement by solar radiant energy. Radiant energy is transmitted through a transluscent plate 46 of the panel and impinges upon conduit means 47 which extends in a plane in the panel and is positioned for impingement by radiant energy. Solar collector panels of this type are known in the art and are adapted to heat the circulating fluid to a sustained temperature in the range of 150° F.–160° F. One such panel suitable for application in the use described herein is a solar panel model RSS5 available from American Sun Systems, Inc. of Milford, Conn. A liquid such as water is recirculated between a reservoir 24 and the conduit 47 of the solar panel 42 via the conduit 16 and the pump 17.

The preheating means 14 (in FIG. 2–5) comprises the reservoir 24 containing the first liquid 26 which is circulated between the energy source 12 and the reservoir and a means for causing the liquid 26 to vaporize and for compressing the vapor. The means for causing the liquid to vaporize comprises a pump 30 and a conduit 32 coupling an inlet port 33 of the pump to an upper sector 28 of the reservoir 24. The reservoir 24 is an enclosed tank which is pressure sealed and the pump 30 is preferably driven by an electric motor. Operation of the pump 30 establishes a reduced pressure in the resevoir 24 which causes the liquid 26 to boil at the temperature of the liquid within the reservoir. The pressure in the reservoir 24 is established at about the vapor pressure of the liquid 26. For a liquid 26 comprising water at a temperature of about 150° F., the pump 30 will establish a pressure of about 3.8 lbs. per sq. inch within the reservoir, thus causing the water to boil. Reservoir 24 preferably has a relatively large surface area to volume for enhancing the boiling of the liquid 26. Operation of the pump 30 also causes the vaporized liquid 26 to be conveyed from the reservoir through the conduit 32 and to the inlet port 33 of the pump and to be discharged under pressure to a heat exchanger 34.

A means for compressing the vapor includes the pump 30, and an enclosed volume provided by a flow path of a heat transfer means 34 which is positioned in the generator of the absorption refrigeration apparatus 10 and is formed by an elongated condensing coil 34, a conduit 36 coupled between an outlet port 37 of the pump 30 and the heat exchanging means 34 and a throttling valve 38. Vapor which is drawn from the reservoir 24 by the pump 30 is discharged through the outlet port 37 into the conduit 36. The throttling valve 38 restricts flow and the pump 30 establishes a relatively higher pressure in the volume between the outlet port 37 and the throttling valve 38.

A heat exchange means is provided by the coil 34 which establishes an enclosed flow path for the vapor through the generator and wherein the vapor is cooled and condenses. Energy is supplied to the vapor during compression by the pump 30 and this energy is derived from the electric motor or other mechanical or electro mechanical drive means. As the compressed vapor is cooled in the condensing coil 34 by the relatively strong liquor of the generator, the vapor of the first fluid gives up its heat of vaporization. This heat is transferred to the strong liquor of the generator which, in the case of an ammonia refrigerant, is a strong solution of ammonia and water and, in the case of a lithium bromide refrigerant, is a strong solution of lithium bromide. A heated strong liquor operates in a known fashion to cause cooling of the second liquid means which is in heat transfer relationship with an evaporator of the absorption refrigeration apparatus and the utility device (FIG. 6). A more detailed description of a lithium bromide absorption refrigeration apparatus is given hereinafter. The output fluid from the condenser 34 is hot water which is approximately at about the same temperature as the vapor flowing into the condenser. When the pump 30 produces sufficient pressure to create a pressure of about 11.4 lbs. per sq. inch, the vapor and water output from the condenser will be approximately at 200° F.

A conduit 40 couples the throttling valve 38 to the reservoir 24 and returns the effluent of the heat exchanging condenser 34 to the reservoir. The pressure in the conduit 40 is reduced since a substantial part of the water vapor has condensed. The pressure in the conduit 40 is approximately at the pressure of the reservoir 24 which, as indicated hereinbefore, is at the vapor pressure of the vaporized liquid 26. The vapor pressure for the liquid water at 150° F. is about 3.8 lbs. per sq. inch and at this pressure and temperature, approximately 5 percent of the condensate from the condenser 34 will have been revaporized and the balance will be in liquid phase. The heat source 12 will generally heat the first liquid 26 to a temperature in the range of up to about 140° F. to 160° F. Vaporization of this liquid and successive compression of the vapor by the pump 30 elevates the temperature of the vapor to about 200° F. which temperature is in the desired range for efficient operation of a lithium bromide absorption refrigeration apparatus. Thus, a relatively energy efficient means is provided for increasing the temperature of the first fluid and effecting an efficient operation of the absorption refrigeration apparatus.

Figure 3:
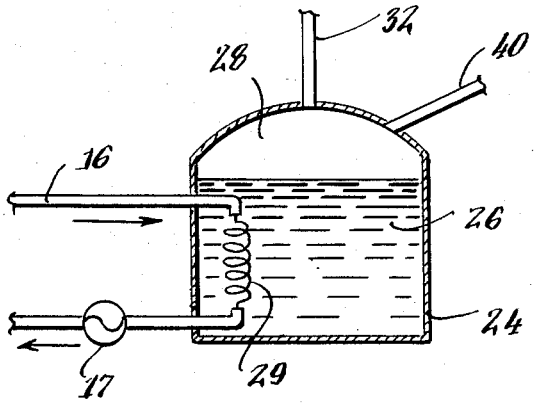
FIG. 3 is a fragmentary view of the apparatus of FIG. 2 illustrating an alternative preheating means of the present invention.

FIG. 3 illustrates an alternative arrangement for heating the first fluid 26 to the temperature $T_0$. The heat source 12 is in heat transfer relationship with the first fluid 26 and energy is transferred thereto by a supply fluid which is conveyed through the supply conduit 16, a heat exchanging coil 29 positioned within the reservoir 24 and a pump 17. The first fluid 26 which preferably comprises water may alternatively comprise a mixture of propylene glycol and water.

FIG. 6 illustrates a lithium bromide absorption refrigeration apparatus. A generator 66 of the apparatus contains a strong solution of water and lithium bromide. The addition of heat energy by the first fluid which flows through the condensing coil 34 causes the evaporation of hot lithium bromide vapor under pressure. The lithium bromide vapor is conveyed to a condenser 50 in series with a throttling valve 52 where the vapor is cooled to a liquid. The condenser 50 is in heat transfer relationship with a liquid which circulates between the condenser 50 and a cooling tower 54. Heat energy given off during the condensation of the lithium bromide vapor is conveyed by this fluid medium to the cooling tower 54 where the heat energy is discharged to the environment. Cooled liquid lithium bromide is conveyed from the throttling valve 52 to an evaporator means 56 which is in heat exchange relationship with a second fluid medium which circulates between the utility apparatus 20 and the evaporator means 56. The lithium bromide evaporates in the evaporator means 56 thereby absorbing heat from the second fluid medium and chilling this liquid. This chilled second liquid is recirculated to the utility apparatus 20 for providing air conditioning and cooling of an enclosed environment.

Lithium bromide vapor is conveyed from evaporator means 56 to an absorber tank 60 where is dissolves in water to form a lithium bromide water solution. This solution is pumped by pump 62 to a heat exchanger 64 where it is warmed by heated water conveyed thereto from the generator 66. Warm lithium bromide water solution is conveyed from the heat exchanger 64 to the generator 66 where the first fluid, condensing in the heat exchanging coil 34, supplies energy to the solution and causes vaporization of the lithium bromide which flows to the condenser 50 while the heated water flows to the absorber 60 via the heat exchanger 64 where it warms the lithium bromide solution. The apparatus thus continues to recycle. A lithium bromide absorption apparatus of this type is presently available from the Servel Division of Arkla Industries, Inc. An absorption refrigeration apparatus utilizing a lithium bromide refrigerant as described is particularly advantageous because the efficient operation of the apparatus is effected at a relatively low temperature range ($T_1$–$T_2$) of a heated first fluid supplied to the heat transfer condensing coil 34. A typical temperature range ($T_1$–$T_2$) for a lithium bromide apparatus is 190° F.–210° F.

Referring now to FIGS. 7–12, the preheating means 14 comprises a rotary pump 72 positioned in a pressure vessel 70. The pressure vessel 70 has a generally cylindrically shaped central section and is closed at opposite ends by spherically shaped segments. The rotary pump assembly 72 is mounted within the vessel 70. The pump assembly 72 includes a first pressure plate 74 and a second pressure plate 76 which form with an annular segment 78 of the vessel an enclosed compression chamber. The vessel 70 is divided into three distinct chambers: The compression chamber as indicated, a first relatively low compression chamber 79 formed by the vessel 70 and pressure plate 74 and a relatively higher compression chamber 80, formed by the vessel 70 and the plate 76. The first pressure plate 74 includes an inlet port 82 which communicates between the compression chamber and the low pressure chamber 79. The second pressure plate 76 includes an outlet port 84 which communicates between the compression chamber and the higher pressure chamber 80. The ports 82 and 84 are positioned at diametrically opposite locations in the vessel 70. These ports are valved by piston surfaces as indicated hereinafter.

A rotary piston means is provided and includes a first rotary, wedged-shaped piston member 86 and a second rotary, wedged shaped piston member 88. These piston members are positioned in the compression chamber in sliding engagement with the pressure plates 74 and 76 and the annular segment 78 of the vessel. The presure plates 74 and 76 and the annular segment 78 as well as the pistons 86 and 88 are pressure sealed for providing that upon rotary motion of the pistons, as indicated hereinafter, a relatively high pressure is established within the compression chamber. The sealing is provided by various well known techniques including the use of gaskets, seals, and coatings on the various surfaces as for example by, TEFLON which reduces sliding frictional engagement between the various members while providing the desired seal. The details of the sealing is not illustrated in order to simplify the drawings.

The pistons 86 and 88 include mutual engagement means. Piston 86 includes an internal circular hub segment 90 which functions as a rotary pivot post for the piston 88. The segment 90 has an axis 92 which is centrally orientated within the compression chamber and which is an axis of rotation for the pistons 86 and 88. As indicated hereinafter, these pistons are subjected to intermittent motion during a cycle of operation. When the piston 86 is stationary and during its rotary movement the piston 88 which includes a recessed arc segment 94 conforming with the circular shape of the segment pivots about hub segment 90. When the piston 88 is stationary, the segment 90 of the piston 86 rotates on a bearing surface provided by the arc segment 94 of piston 88.

A means for imparting rotary motion to the pistons is provided and includes and electric motor having an output shaft and a drive means for mechanically coupling the output shaft of the motor to the pistons 86 and 88. The electric motor 96 is supported within the low pressure chamber 79 by a support spider 98 which is mounted, such as by welding or other suitable means, to an interior surface of the vessel 70. One end of the motor output shaft 100 is positioned in a bearing 102 which is mounted to the pressure plate 74. The motor 96 is energized by the application of electrical energy coupled thereto via electrical wires 101 and insulating feed through terminals 103 which extend through vessel 70.

The drive means further includes a spur gear 104 which is mounted to the motor output shaft 100 for rotation therewith. A shoulder segment 106 is provided on piston 86 having gear teeth 108 formed in a semicircular array on the segment. Similarly, the piston 88 includes a shoulder segment 110 and gear teeth 112 formed therein in a semicircular array along the segment. Rotary motion is imparted from the drive gear 104 to the pistons by a first idle-gear pair 113 including idle gears 114 and 116 which are supported on a shaft 118 which is mounted on a bearing surface 120 and supported on the pressure plate 74. A similar second idle-gear pair is provided and is referenced generally by numeral 122 in FIGS. 8–12. The first and second idle-gear pairs are spaced apart along a line of a circle and are positioned in engagement with the spur gear 104. As the motor shaft 100 rotates, intermittent motion is imparted to the pistons 86 and 88 through the drive train including the gear 104, the idle gear pairs and the gear segments formed in the pistons.

The pistons as viewed in FIGS. 8–12 rotate in a counterclockwise direction. During compression one piston is restrained while the other rotates to compress the vapor between it and the stationary piston.

A means for intermittently inhibiting motion of one piston during compression at a predetermined location in the compression chamber 15 provided. This means includes a release rod 125 which extends through a bore 126 formed in the piston 86. A similar release rod 127 is positioned in and extends through a bore 128 of piston 88. End segments 129 and 130 of the release rods 125 and 127 respectively are maintained in a retracted position within their bores by bias springs 131 and 132 respectively and are recessed. However, opposite ends 133 and 134 of the rods 125 and 127 extend from trailing rearward surfaces of the pistons. A piston is restrained in a predetermined position during compression as illustrated by the piston 86 in FIG. 8 by a lock pin 136 (FIG. 12) which is positioned for reciprocating motion in a bore 137 formed in the annular vessel segment 78. A spring 141 applies a bias force to the lock pin 136 which causes a friction reducing roller 142 supported at one end of the pin to contact a moving periphery 143 of a piston and to engage and lock the pin in the release rod bore 126 when this bore is aligned with the lock pin. At this location, the lock pin extends into the bore 126 and contacts the recessed end portion 129 of the release rod 125. Engagement between the periphery of the lock pin and the wall of the bore both indexes the restrained piston and restrains its motion.

Figure 9:
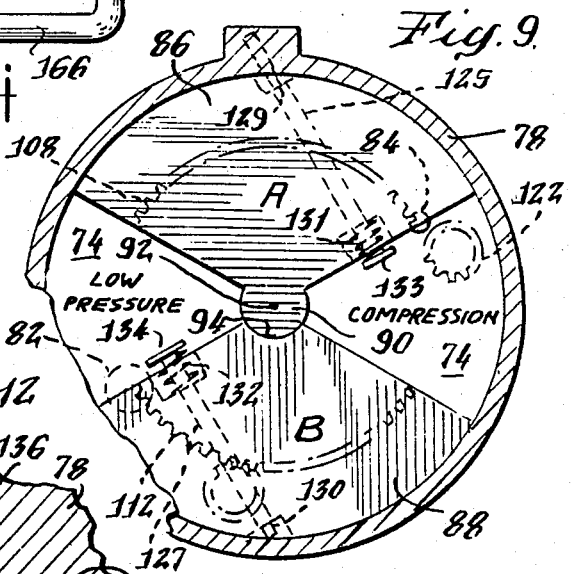
FIGS. 9–11 illustrate the pistons of FIG. 8 at different orientations.
Figure 12:
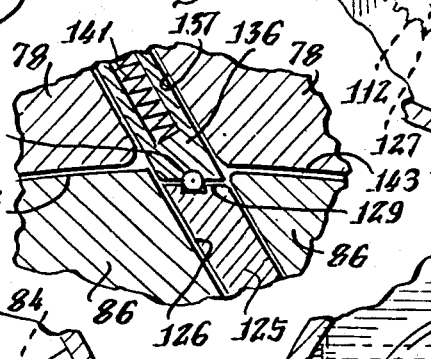
FIG. 12 is an enlarged fragmentary view in section of a lock pin arrangement for the rotary pump of FIG. 7.
Figure 10:
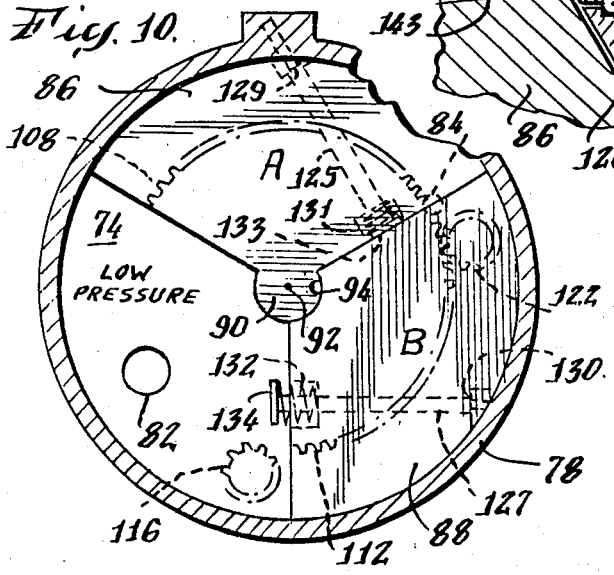

A lock pin is automatically released as the piston 88 (or the piston 86 when the piston 88 is locked) completes its compression movement as illustrated in FIGS. 9 and 10. In this position, the extending end segment 133 of the release rod 125 is forced inwardly against the spring bias 131 thereby causing movement of the opposite distal segment 129. As segment 129 advances in the bore it forces the lock pin 136 outwardly (FIG. 12) from the bore thus removing the restraining force imparted to the piston. Rotary motion of the piston 88 and contact with piston 86 simultaneously causes release of the pin 136 and forces the piston 86 to rotate away from the indexed position. A mechanical bias force exerted on lock pin 136 by spring 141 then causes the friction reducing roller 142 to engage the periphery 143 of the piston as the piston rotates from this location. Subsequent in the cycle, lock pin 136 and bore 128 of piston 88 will align and the lock pin 136 will automatically enter and engage this bore to lock the piston 88 in position as was described above with respect to the piston 86. Release of the piston 88 will be accomplished in the same matter as was release of piston 86 when piston 86 completes compession movement and engages the extending end 134 of the rod 127.

Figure 8:
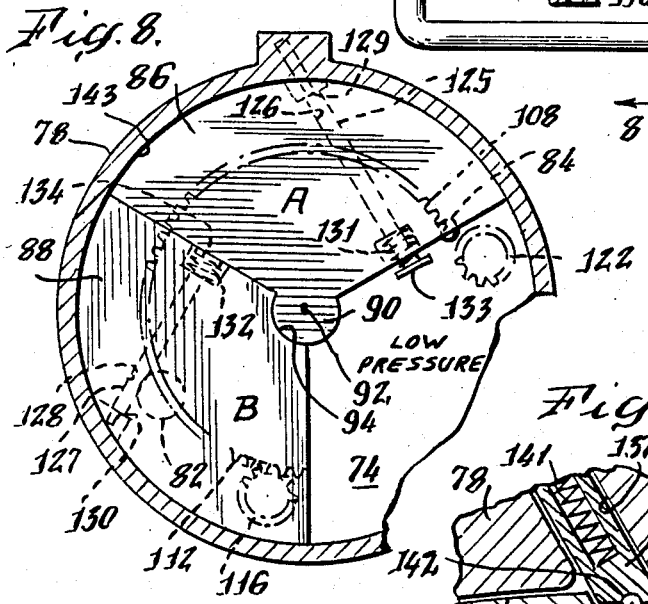
FIG. 8 is a view taken along line 8—8 of FIG. 7 illustrating rotary pump pistons at one orientation of a pumping cycle.
Figure 11:
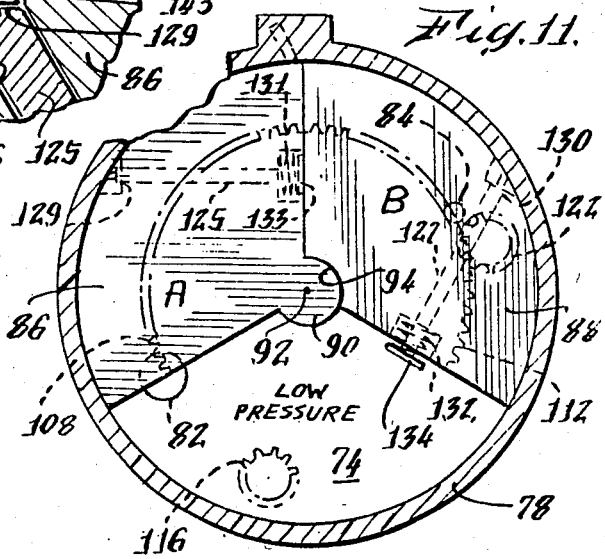

The pistons 86 and 88 and the first and second idle gear pairs 113 and 122 which engage these pistons are sized and are spaced apart for providing that at least one gear pair is at all times maintained in engagement with one of the pistons. This is accomplished by selecting an arc width for each of the pistons and by providing an arcuate spacing between the gear pairs which is slightly less than the smallest arc width of the pistons. In FIG. 8, the gear 86 is locked in position and is in contact with the piston 88. In this position the first gear pair 113 engages the gear 88. In FIG. 9, the first gear pair 113 continues to engage piston 88. Prior to disengagement the second gear pair 122 engages the piston 88. FIG. 10 illustrates piston 88 engaged by the second gear pair 122. In FIG. 11, the second gear pair continues to engage piston 88 and advances it to a lock position (not shown) at which location the gear 86 will be engaged by the first gear pair. In general, when the pistons occupy an arcuate width of about a 120° each as illustrated in the drawings, the arcuate spacing between the gear pairs should be slightly less to provide for overlapping engagement with the pistons.

Figure 7:
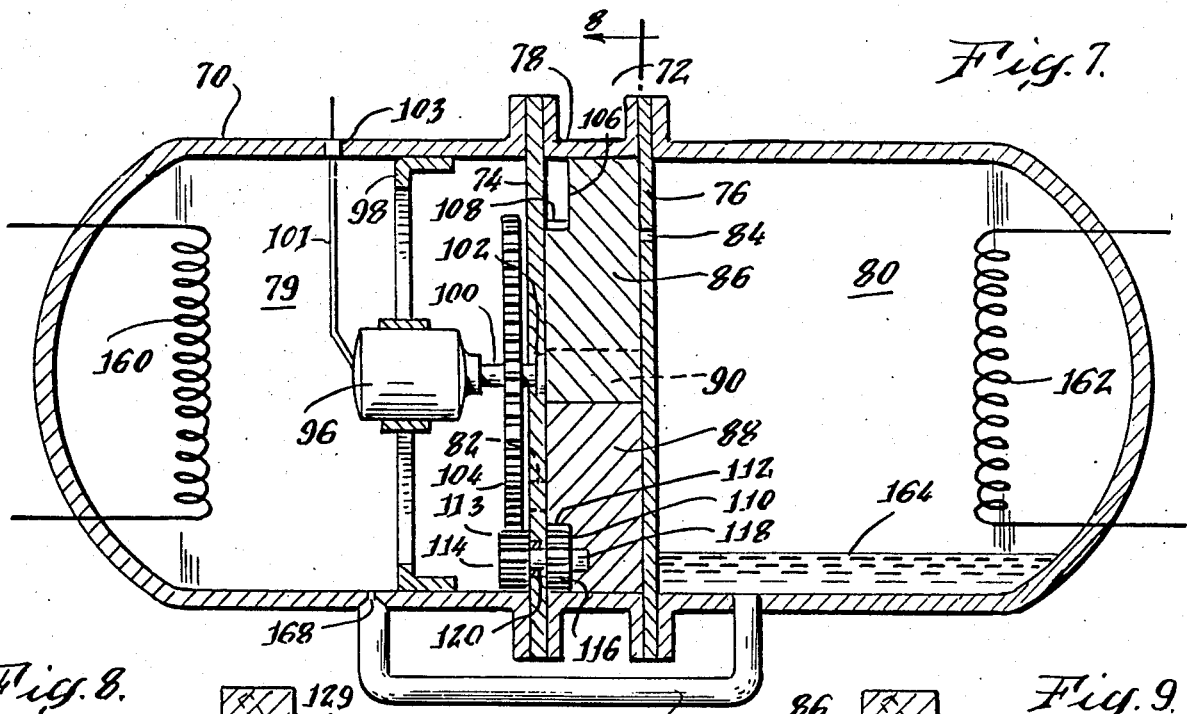
FIG. 7 is a sectional view of a pressure vessel and rotary pump constructed in accordance with features of the invention.

The pump 72 can alternatively be operated with the arrangement of FIG. 7 or operate simply as an in line rotary pump. In the latter case, pump 72 is placed in line and it would represent the pump 30 illustrated in FIG. 2 of the drawings. In the former case solar energy is supplied to the low pressure chamber 79 of the vessel 70 through an inlet heat transfer conduit 160. A heat exchange conduit 162 is positioned in the high pressure chamber 80. The fluid condensate 164 from the high pressure chamber is returned to the low pressure chamber 79 through a fluid returning conduit 166 and a restriction 168. This heat transfer fluid comprises water for example.

In operation, the pistons 86 and 88 are rotated to provide a flow of the vapor from the low pressure chamber 79 into the pump compression chamber and flow of the compressed vapor from the compression chamber into the high pressure chamber 80. FIG. 8 illustrates orientation of the pistons in the compression chamber at the beginning of compression. The leading and trailing surfaces of the pistons 86 and 88 respectively are juxtaposed and a relatively low pressure exists in the space between the pistons as illustrated. The low pressure inlet port 82 is valved closed by the surface of piston 88. Piston 86 is locked stationary and rotation of the piston 88 in a counter clockwise direction will reduce the volume and increase the pressure in the compression space as illustrated in FIG. 9. At the same time rotation of piston 88 enlarges the volume of the space adjacent to the inlet port 82 thus reducing pressure in the space. In FIG. 9, the inlet port 82 is shown being valved open to permit entrance of vapor from the low pressure chamber 79. Continued counter clockwise motion of the piston 88 compresses the vapor in the compression space and forces the compressed vapor into the high pressure chamber 80 through the outlet port 84. In FIG. 10, compression is shown to be completed; the outlet port 84 is closed; and the inlet port 82 is fully open. The piston 88 continues to be driven by gear pair 122 to unlock the restraining means as indicated hereinbefore and forces the piston 86 to rotate in a counter-clockwise direction to partly seal the low pressure port 82 as illustrated in FIG. 11. Continued rotation of the piston 88 by gear pair assembly 122 advances the piston 88 to the restrained position and forces the piston 86 into engagement with gear pair 113 (not shown). At this location gear pair 113 engages the piston 86 and causes its continued rotation. The compression movement of piston 86 will then begin as was illustrated in FIG. 8 with the exception that the positions of pistons 86 and 88 are interchanged, i.e., piston 88 is now stationary while piston 86 provides compressing movement. The motor 96 thus causes the pumping of vapor from the low pressure 79 chamber to the high pressure 80. With this arrangement, relatively high compression is provided and efficiency is relatively high since frictional heat losses from the heat pump and motor 96 are recycled. Solar energy thus flows to the low pressure chamber and flows at a stepped up temperature from the high pressure chamber to the heat exchanger 162.

An improved method and apparatus for absorption refrigeration has thus been described which employs a relatively simple, non-complex and relatively inexpensive arrangement for elevating the temperature of a heated thermal energy supply fluid for a generator of the apparatus. An efficient rotary pump is provided. The apparatus can therefore advantageously be utilized with sources of energy which heat thermal energy transfer mediums to a relatively low temperature below the efficient operating temperatures of the apparatus. In a particular advantageous arrangement, a solar energy source is provided.

While there has been described a particular embodiment of the method and apparatus of the invention, it will be appreciated by those skilled in the art that variations may be made thereto without departing from the spirit of the invention and the scope of the appended claims.

What is claimed is:

1. An improved absorption refrigeration apparatus comprising:

a. an absorption refrigeration means having a generator in heat transfer relationship with an inlet fluid and an evaporator, said refrigeration means adapted to receive thermal energy supplied to said generator by said inlet fluid and to utilize said thermal energy for causing cooling at said evaporator;

b. said refrigeration means adapted to operate efficiently at and above an inlet fluid temperature $T_1$;

c. an enclosed vessel having a heat transfer medium and a rotary pump positioned therein;

d. said pump dividing said vessel into first and second relatively low and high pressure chambers respectively;

e. means for conveying said inlet fluid to said second chamber in heat transfer relationship therewith for heating said inlet fluid at least to the temperature $T_1$;

f. a solar energy source;

g. means for providing a heat transfer relationship between said solar energy source and said first chamber for heating said heat transfer medium in said first chamber to a temperature $T_0$ which is less than said temperature $T_1$;

h. means for imparting intermittent rotary motion to a pump piston for causing said pump to successively draw and vaporize said medium from said first chamber, compress said vaporized medium, and discharge said compressed vaporized medium to said second chamber; and, i. said vessel including means for conveying said heat transfer medium in liquid form from said second to said first chamber.

* * * * *